US005813839A

United States Patent [19]

Newby

[11] Patent Number: 5,813,839

[45] Date of Patent: Sep. 29, 1998

[54] GAS DRIVEN EXTERNAL COMBUSTION HEAT ENGINE PUMP HAVING THE OUTLET PIPE CONNECTED TO A VARIABLE BUOYANT FLOAT

[76] Inventor: John C. Newby, P.O. Box 989, Cobb, Calif. 95426

[21] Appl. No.: 863,787

[22] Filed: May 27, 1997

[51] Int. Cl.[6] ..... F04B 53/00

[52] U.S. Cl. ..... 417/61; 417/126; 417/279; 417/209; 60/641.15

[58] Field of Search ..... 417/61, 118, 137, 417/138, 139, 207, 209, 279; 60/641.14, 641.15

[56] References Cited

U.S. PATENT DOCUMENTS

| | | | |
|---|---|---|---|
| 30,306 | 12/1860 | Ericssons . | |
| 37,299 | 1/1863 | Messor . | |
| 291,285 | 1/1884 | Breese . | |
| 3,631,880 | 1/1972 | Hansel . | |
| 3,847,508 | 11/1974 | Mowen | 417/118 |
| 3,902,825 | 9/1975 | Quillen . | |
| 3,972,651 | 8/1976 | Flecher . | |
| 4,041,707 | 8/1977 | Spector | 60/641.14 |
| 4,181,470 | 1/1980 | Qillet . | |
| 4,227,866 | 10/1980 | Stubbs | 60/641.15 |
| 4,304,528 | 12/1981 | Jorden . | |
| 4,309,148 | 1/1982 | O'Hare . | |
| 4,469,472 | 9/1984 | Newby . | |
| 4,508,493 | 4/1985 | O'Hare | 60/641.15 |
| 4,821,516 | 4/1989 | Isahiki | 60/641.14 |
| 5,139,659 | 8/1992 | Scott . | |
| 5,662,459 | 9/1997 | Newby | 417/61 |

*Primary Examiner*—Timothy Thorpe
*Assistant Examiner*—Peter G. Korytnyk

[57] ABSTRACT

An external-combustion heat engine pump, one version consisting of four chambers, one liquid and one gas pumping chamber, a gas heating chamber and a gas cooling chamber. The two pumping chambers are connected by two tubes, one near the bottom of the chambers and one at the top of the chambers. The liquid pumping chamber, which contains a cycling container, is connected to a reservoir with tubing and a one way valve allowing liquid to enter. The gas pumping chamber is fitted with a bellows, which rises or falls as determined by the location of the cycling container. Gas enters the bellows through a one way valve connected to the bellows with tubing. The bellows is also connected to the heating chamber with tubing and with a one way gas valve which allows gas to enter this chamber. In operation, with the cycling container resting on the bottom of the liquid pumping chamber and the bellows contracted, the gas within the system is being heated (by any practical means) in the heating chamber, the resultant pressure build-up in turn force's liquid out of the two pumping chambers and out of the cycling container tube. As the liquid level drops the bellows expands, its pressure drops and gas flows into it from the cooling chamber. When the chambers's liquid reaches a predetermined level, the pressurized gas is released to the atmosphere through the cycling container tube, liquid from the reservoir refills the two pumping chambers, as they refill the bellows contracts forcing cool gas into the heating chamber now open to the atmosphere. When the pumping chambers refill, the cycling container sinks and the cycle repeats.

4 Claims, 5 Drawing Sheets

GAS DRIVEN EXTERNAL COMBUSTION HEAT ENGINE PUMP HAVING THE OUTLET PIPE CONNECTED TO A VARIABLE BUOYANT FLOAT

BACKGROUND OF THE INVENTION

1. Field of the invention

This invention relates generally to external combustion heat engine pumps and more particularly to heat engines pumps powered by expansion of air and/or steam.

This invention relates to the assembly and integration with an existing patent (described in U.S. patent application Ser. No. 08/5,662,459 of Newby ) which is a liquid pump, to components that will convert the pump into an external combustion heat engine pump.

2. Description of Prior Art

In the mid-nineteenth century. Augustin Mouchot designed a solar pump which included a sealed, copper cylinder partially filled with water and a parabolic reflector for focusing sunlight on the cylinder. As the air expanded the water was forced from the cylinder through a one way check valve.

In 1872 Captain John Ericsson, a Swedish-American inventor designed a solar motor that was powered by solar heated air rather than steam. It was a hot-air external combustion engine. It operated when heat was applied to a cylinder which caused air inside the piston to expand and push down a piston within the cylinder, at the end of the downward stroke inrushing cold air pushed the piston up again. The cycle would repeat.

A more modern example of a solar pump is found in U.S. Pat. No. 3,972,651 of Fletcher. The pump includes a hermetically sealed enclosure floating on a reservoir of water. The enclosure includes a solar heated chamber and a cooling chamber that communicates through a plurality of heat sinks. At the bottom of the enclosure there is a sump which is in communication with the reservoir of water via a one way valve. When the air in heated chamber expands it will flow through the heat sinks into the cooling chamber and exert pressure on the water in sump to force it up a conduit to an output flume. Flecher's device is metered by a tipple which is filled by dribbles of water from the flume. When the tipples filled with water it will tip over, raising a 'displacer' which separated the chambers. This cools the air with in the enclosure and causes water to flow into the sump through the valve when the tipple empties the displacer falls and the cycle is repeated.

Flechers's device is an example of a closed system solar pump, that is, the same air is used over and over during the expansion and compression cycles and is never vented to the atmosphere. As such, Flecher's pump has many points of similarity with the Sterling hot air engine, which is a classic example of a closed system heat engine. At problem with a closed system pumps or engines is that their design is complicated by the need for complete pressure integrity, and by the elaborate heat dissipating mechanisms required to cool the air between cycles. For example, most of the complexity in Flecher's device is found in the displacer and tipple mechanism which cools the air within the enclosure. Similarly, a Starling hot air engine requires water jackets around the compression cylinder and/or an elaborate array of heat radiating fins. A modern example of an open system pump is found in U.S. patent application Ser. No. 08/565,917 of Newby, a simplified version of an open system pump is shown. It is shown to include a hollow chamber, a cycling container disposed within the chamber, and a flapper type check valve.

Briefly, the invention includes a hollow chamber, with an attached float and a hollow cycling container, open at the top, disposed within the chamber. The cycling container is coupled to a pipe which is attached to a flexible tube joint near the bottom of the enclosure wall, the joint in turn is coupled to the a outer pipe on the outside of the enclosure. This allows communication between the cycling container and the outside pipe. When the cycling container is empty it becomes buoyant. Whenever the cycling container is buoyant the pressurized gas within the chamber will escape. Whenever the cycling container is submerged the gas entering through the input pipe will be contained and the pressure within the chamber will rise until it forces water out of the output pipe. The circular arc distance the cycling container can travel upward is determined by the length of the output pipe attached. Whenever the cycling container is raised to the level the pipe length will allow, the container will be rotated into a position that allows water to enter, the container loses its buoyancy and sinks to the bottom of the chamber. Once again the cycling container is submerged and the gas entering the chamber through the input pipe is again captured.

An advantage of the invention is that it is an open system mechanism, i.e, the gas and/or steam is vented to the atmosphere between each cycle. This design allows for simplified construction and reduces the need for radiators and/or other cooling mechanism another advantage of this invention is the unique design of a cycling container to utilize the forces of buoyancy and gravity to recycle the system.

SUMMARY OF INVENTION

The assembly consist of four major components, two are pumping chambers one of these is the liquid pumping chamber which contains a cycling container, the other is the gas pumping chamber which contains a gas bellows. The remaining chambers are a heating chamber and a cooling chamber.

The two pumping chambers are connected by two pipes, one located near the top of the chambers, the other near the bottom of the chambers allowing free communication of both gas and liquid between the two chambers. This liquid pumping chamber is connected to the reservoir with tubing and a one way valve that only allows liquid to enter the chamber. The bellows, located within the gas pumping chamber, is connected to both the heating chamber (which is heated by an external heat source) and the cooling chamber with each tubing fitted with one way air valves.

In operation, the gas within the system is heated in the heating chamber, by the external heat source. The resultant pressure produced forces liquid out of the two pumping chambers and out of the cycling container tube. As the liquid level drops in the two pumping chambers, the bellows lower end supported by the liquid also drops, which opens the bellows. The pressure within the bellows drops, gas flows into the bellows from the cooling chamber. The liquid within the two pumping chambers continues to flow out of the system until the pressurized gas within the two chambers is released through the cycling container tube. The pressure within the two chambers becomes atmospheric. The pressure of the reservoir is now greater and liquid from the reservoir refills these two chambers. As they refill, the liquid level rises and the bellows contracts its pressure rises, forcing cool gas into the heating chamber now open to the atmosphere. Once the chambers are filled and the cycling container has sunk, the heating chamber is no longer open to the atmosphere, the pressure builds up and the cycle repeats.

The advantage of the present invention is that it is an open system mechanism, i.e., the gas and/or steam is vented to the atmosphere between each cycle. This design allows for simplified construction and reduces the need for expensive radiators and/or other cooling mechanism another advantage of this present invention is that unique design of a cycling container to utilizes the forces of buoyancy and gravity to recycle the system Another advantage of this present invention is that it can function with only three valves limiting the number of wearing parts.

The simple embodiments of this invention would not require any machining.

Another advantage of this present invention is that it can function within a wide range of temperatures from near freezing to above boiling.

Another advantage of this present invention is that it can function with different heating sources, from a charcoal fire to, a solar hotbox or solar heat concentrating collectors.

Another advantage of this present invention is that it is a combination of a external combustion heat engine and a liquid pump. Which is assembled with fewer palls than similar conventional assembles require.

DETAILED DESCRIPTION OF THE PREFERRED EMBODIMENT(S)

Figure 1:
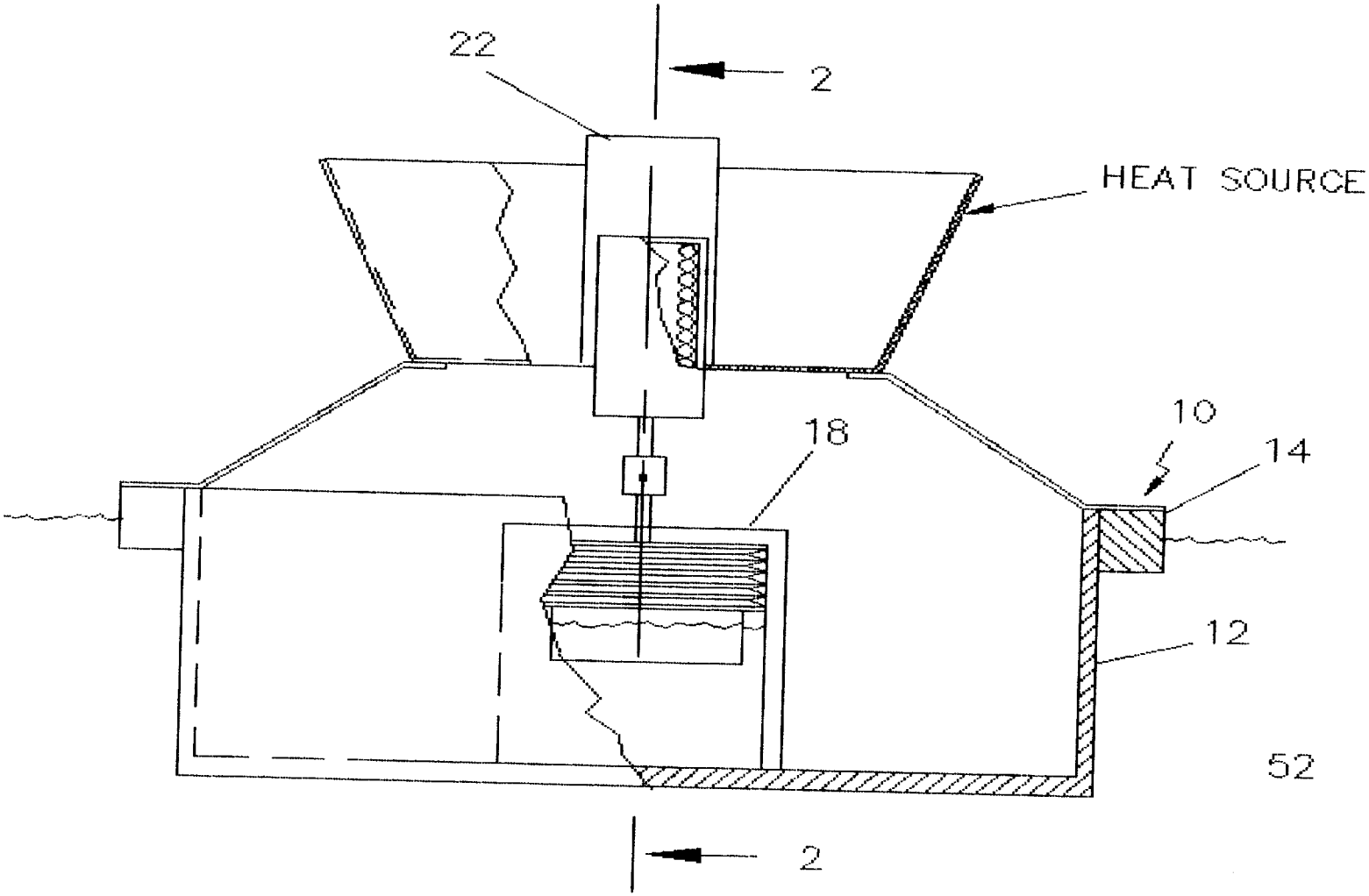
FIG. 1 is an elevational view of a preferred embodiment of the present invention.
Figure 2:
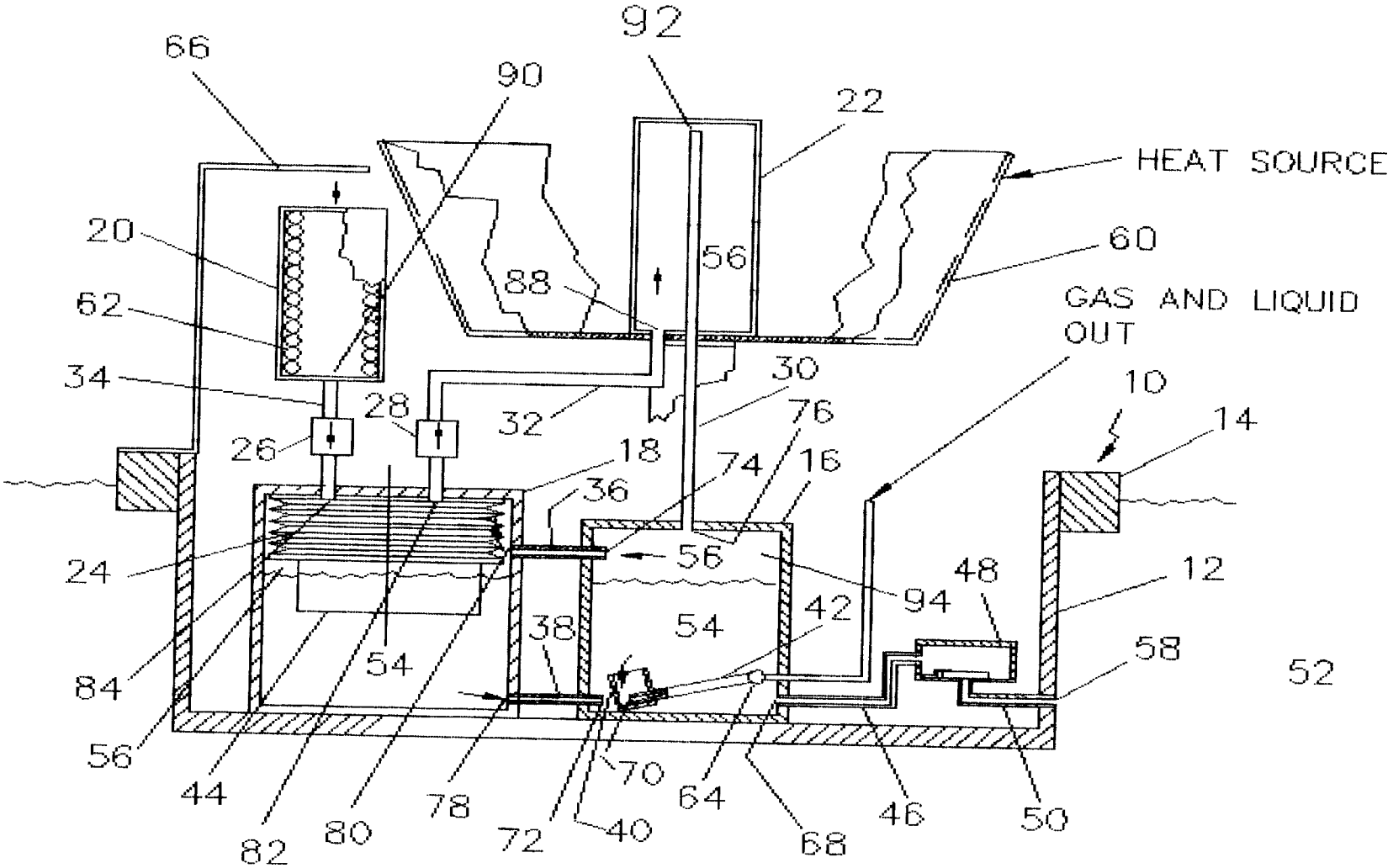
FIG. 2 is a cross section taken along line 2—2 of FIG. 1 with the pump in the pressure position of its cycle.

Referring to FIGS. 1–2. A heat engine pump mechanism 10. In accordance with the present invention includes an enclosure 12, an enclosure float 14, located within the enclosure, a liquid pumping chamber 16, a gas pumping chamber 18.a cooling chamber 20 and a heating chamber 22 with a heat producing source 60 attached.

Referring more particularly to FIG. 2, the enclosure 12 is a hollow cylinder, but it can be made in and suitable shape. The enclosure float 14 can also be made in any suitable shape. The enclosure 12 is provided with one orifice 58 allowing communication between the reservoir liquid 52 and the liquid valve 48 through reservoir output pipe 50. The liquid pumping chamber 16 is a cylinder, but can be made in any appropriate shape. The liquid pumping chamber 16 is preferably provided with five orifices, allowing communication with the internal liquid pumping chamber 94, namely a gas orifice 76, a liquid input orifice 68 connected to input pipe 46, an output orifice 70 associated with liquid output pipe 42. Output pipe 42 connected to swivel coupling 64. Output pipe 42 is connected to cycling container 40. The orifice 70 located within the cycling container to be positioned so as to evacuate the maximum container liquid 54 when the cycling container is resting on the bottom of the chamber. The remaining two orifices, gas orifice 74 and liquid orifice 72, allow gas and liquid communication between liquid pumping chamber 16 and gas pumping chamber 18 through upper gas pipe 36 and lower liquid pipe 38. The gas pumping chamber 18 is provided with four orifices, namely a gas orifice 80 connected to upper pipe 36, a liquid orifice 78 connected to lower liquid pipe 38. A bellows 24 with attached float 44 is secured to the ceiling of gas pumping chamber 18. One of the two remaining orifices, gas input orifice 84 connects bellows 24 to the gas output pipe 34, through one way valve 26 to gas input orifice 90 located in the bottom of cooling chamber 20. The remaining orifice, gas output orifice 82 connects bellows 24 to output pipe 32 through one way valve 28. The cooling chamber 20 open to the atmosphere at its upper end and is shaded by shield 66 which is coated with reflective material. The inner wall of cooling chamber to be lined with thin walled coiled tubing 62 with water sealed within the tubing. The heating chamber 22 provided with gas output orifice 92 is connected to liquid pumping chamber 16 through output pipe 30. A second gas orifice 88 provides communication with gas pumping chamber 18 through outlet pipe 32 and one way valve 28. Gas 56 is in constant free communication with chambers 16, 18 and 22. Heating chamber 22 is located on solar collector 60.

The operation of the present invention will be discussed with reference to FIGS. 1–2. The beginning of the cycle is shown in FIG. 2. The depth the enclosure sets in the reservoir water 52 is determined by a float 14 attached to the outside of the enclosure. A volume of pressurized gas or steam, generated within heating chamber by an external heat energy source, enters the liquid pumping chamber 16 and the gas pumping chamber 18 through the input pipe 30 and exerts a force upon the surfaces of these liquid. The chambers liquid 54 is forced out of the chambers through the end of the output tube end 70 located within the cycling container 40. When the chamber liquid has been lowered to a predetermined level pressurized gas vents itself through the output tube 42. The chamber pressure of the two pumping chambers is lowered nearly to atmospheric pressure. The bellows 24, with its attached float 44, rises and falls with the changing level is at its extended position and cool gas has been drawn from cooling chamber 20. The reservoir water pressure is now greater than the inner chambers pressure. The flapper valve 48 connected to the reservoir opens, and water flows into the bottom of the chambers. The cycling container, now buoyant, rises as the chambers refills. The bellows float also rises causing the bellows 24 to contract, forcing cool air into the heating chamber 22. Which is now at atmospheric pressure. The cycling container, because of its attachment to the output tube 42 and to the flexible joint 64 near the lower chamber wall, travels in a vertical circular arc as the water moves upward. At a predetermined point the cycling container will begin to fill with water, and when partially filled it is no longer buoyant. It sinks to the bottom of the chamber. The pressurized gas can no longer vent to the atmosphere. The gas 56 now contained begins to exert pressure on the surface of the liquid. The cycle repeats.

Figure 3:
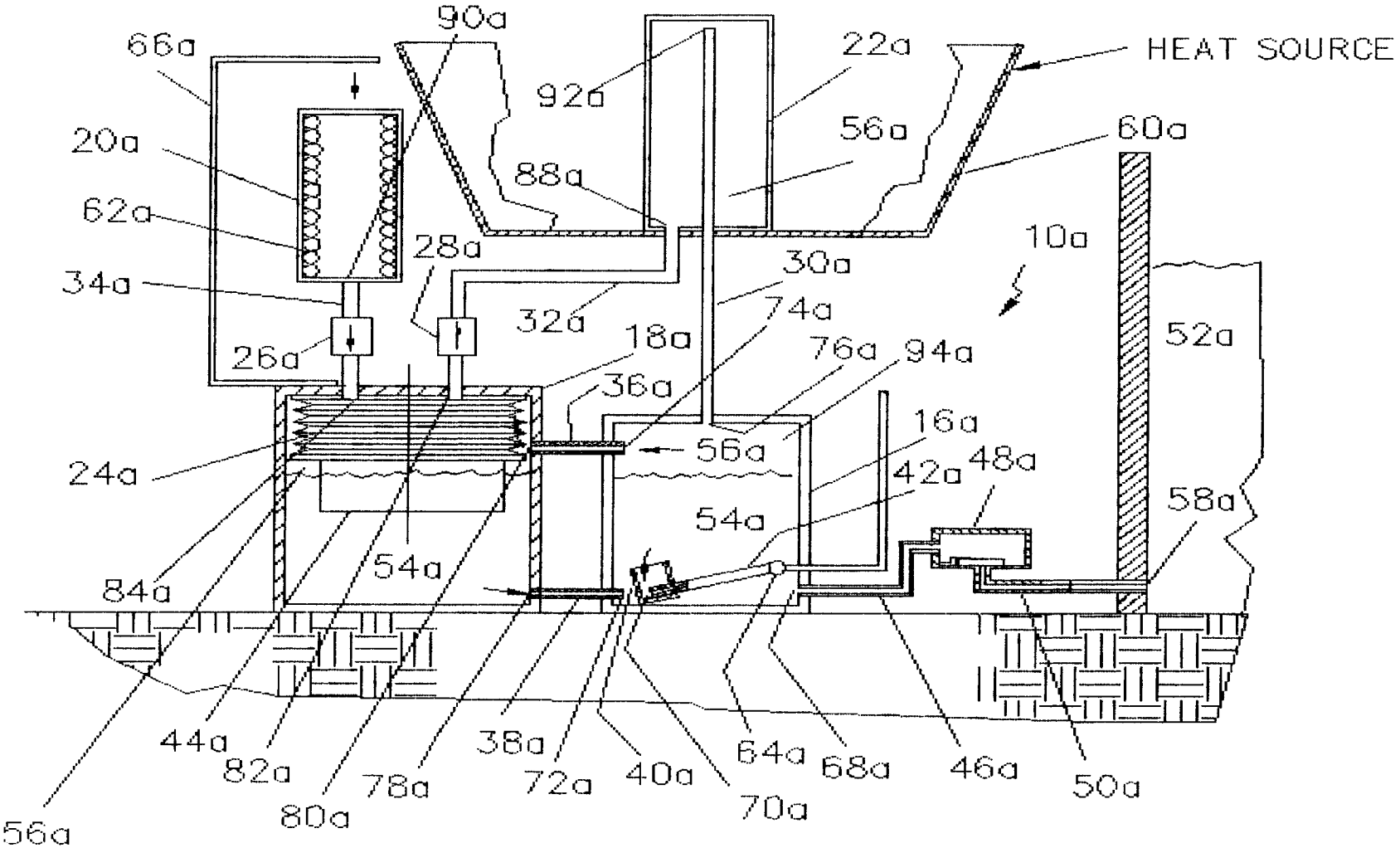
FIG. 3 is a partial cross section of an alternate embodiment of the present invention.

Referring to FIG. 3. A second embodiment of a pump mechanism modified to function as a land based operation near a reservoir.

Referring to FIG. 3. A heat engine pump mechanism 10*a*, a liquid pumping chamber 16*a*, a gas pumping chamber 18*a*, cooling chamber 20*a* and a heating chamber 22*a* with a heat producing source 60*a* attached.

Referring more particularly to FIG. 3. One orifice 58*a* allows communication between the reservoir liquid 52*a* and the liquid valve 48*a* through reservoir output pipe 50*a*. The liquid pumping chamber 16*a* is a cylinder, but can be made in any appropriate shape. The liquid pumping chamber 16*a* is preferably provided with five orifices, allowing communication with the internal liquid pumping chamber 94*a*, namely a gas orifice 76*a*, a liquid input orifice 68*a* connected to input pipe 46*a*, an output orifice 70*a* associated with liquid output pipe 42*a*. Output pipe 42*a* connected to swivel coupling 64*a*. Output pipe 42*a* is connected to cycling container 40*a*. The orifice 70*a* located within the cycling container to be positioned so as to evacuate the maximum container liquid 54*a* when the cycling container is resting on the bottom of the chamber. The remaining two orifices gas orifice 74*a* and liquid orifice 72*a* allow gas and liquid communication between liquid pumping chamber 16*a* and gas pumping chamber 18*a* through upper gas pipe 36*a* and lower liquid pipe 38*a*. The gas pumping chamber 18*a* is provided with four orifices, namely a gas orifice 80*a* connected to upper pipe 36*a*, a liquid orifice 78*a* connected to lower pipe 38*a*. A bellows 24*a* with attached float 44*a* is secured to the ceiling of gas pumping chamber 18*a*. One of the two remaining orifices, gas input orifice 84*a* connects bellows 24*a* to the gas input pipe 34*a* through one way valve 26*a* to gas input orifice 90*a* located in the bottom of cooling chamber 20*a*. The remaining orifice, gas output orifice 82*a* connects bellows 24*a* to output pipe 32*a* through one way valve 28*a* The cooling chamber 20*a* open to the atmosphere at its upper end and is shaded by shield 66*a* which is coated with reflective material. The inner wall of cooling chamber to be lined with thin walled coiled tubing 62*a* with water sealed within the tubing. The heat chamber 22*a* provided with gas output orifice 92*a* is connected to liquid pumping chamber 16*a* through output pipe 30*a*. A second gas orifice 88*a* provides communication with gas pumping chamber 18*a* through inlet pipe 32*a* and one way valve 28*a*. Heating chamber 22*a* is centered on solar collector 60*a*. The gas 56*a* is in constant free communication with chambers 16*a*, 18*a* and 22*a*.

The operation of the present invention will be discussed with reference to FIG. 3. The beginning of the cycle is shown in FIG. 3. A volume of pressurized gas or steam generated within heating chamber the by an external heat energy source enters the liquid pumping chamber 16*a* and the gas pumping chamber 18*a* through the input pipe 30*a* and exerts a force upon the surfaces of these liquid. The chambers liquid 54*a* is forced out of the chambers through the end of the output tube end 70*a* located within the cycling container 40*a*. When the chamber liquid has been lowered to a predetermined level pressurized gas vents itself through the output tube 42*a*. The chamber pressure of the two pumping chambers is lowered nearly to atmospheric pressure. The bellows 24, with its attached float 44*a*, rises and falls with the changing liquid level is now at its extended position and cool gas has been drawn from cooling chamber 20*a*. The reservoir liquid pressure is now greater than the inner chambers pressure. The flapper valve 48*a* connected to the reservoir opens, and liquid flows into the bottom of the chambers. The cycling container, now buoyant, rises as the chambers refills. The bellows float also rises causing the bellows 24*a* to contract, forcing cool air into the heating chamber 22*a*. Which is now at atmospheric pressure.

The cycling container, because of its attachment the output tube 42*a* and to the flexible joint 64*a* near the lower chamber wall, travels in a vertical circular arc as the liquid moves upward. At a predetermined point the cycling container will began to fill with liquid, and when partially filled it is no longer buoyant. It sinks to the bottom of the chamber. The pressurized gas can no longer vent to the atmosphere. The gas 56*a* now contained begins to exert pressure on the surface of the liquid. The cycle repeats.

Figure 4:
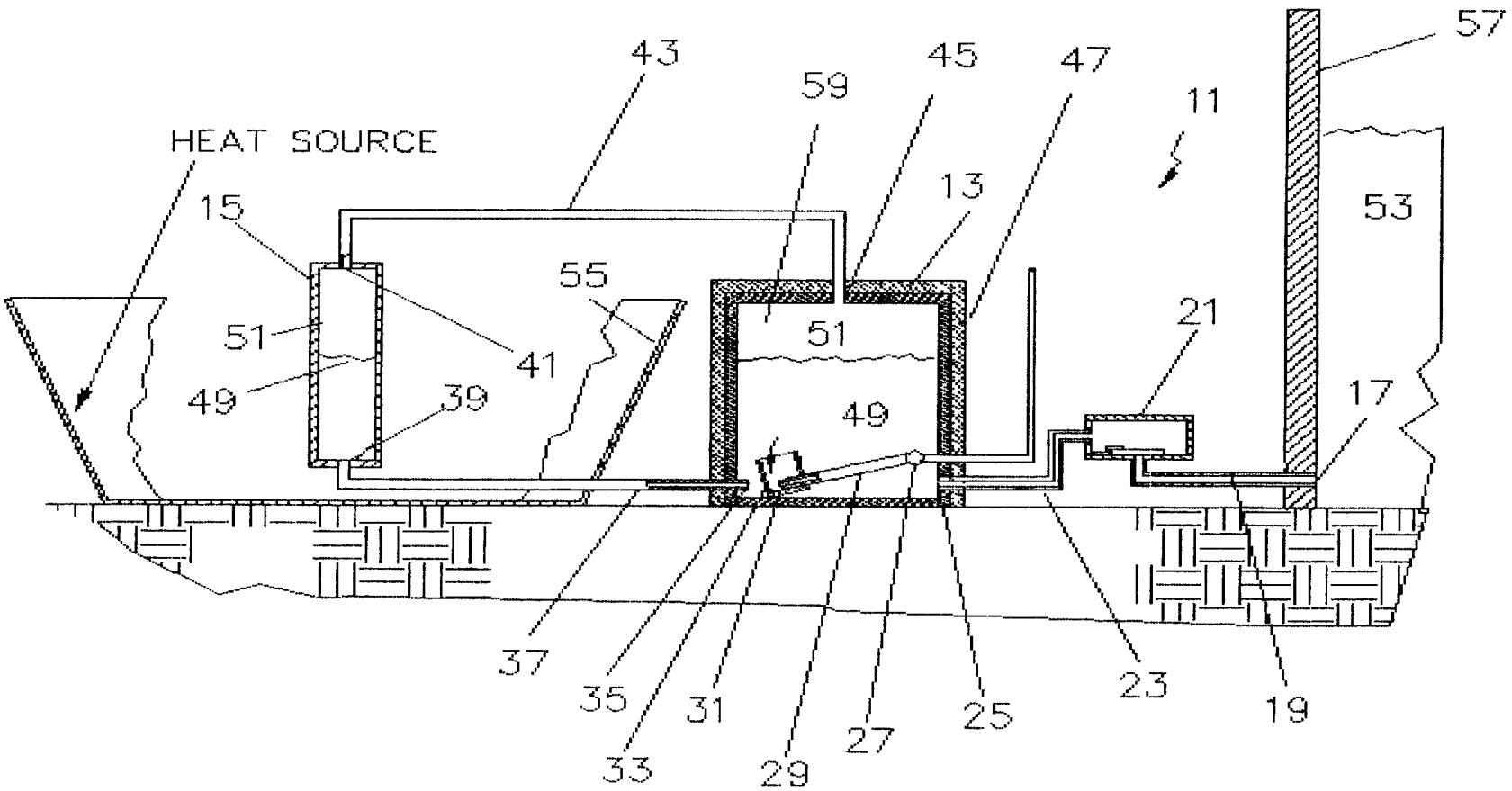
FIG. 4 is a partial cross section of an alternate embodiment of the present invention.

Referring to FIG. 4. A second embodiment of a pump mechanism modified to function as a land based operation near a reservoir.

Referring to FIG. 4. A heat engine pump mechanism 11, a liquid pumping chamber 13, covered with insulation 47, a heating chamber 15 with a heat producing source 55 attached, reservoir 57 provided with one orifice 17 allowing communication between the reservoir liquid 53 and the liquid valve 21 through reservoir output pipe 19. The liquid pumping chamber 13 is a cylinder, but can be made in any appropriate shape. The liquid pumping chamber 13 is preferably provided with four orifices, allowing communication with the internal liquid pumping chamber 59, namely a gas orifice 45, connected to gas pipe 43, a liquid input orifice 25 connected to input pipe 23, an output orifice 31 associated with liquid output pipe 29. Output pipe 29 connected to swivel coupling 27. Output pipe 29 is connected to cycling container 33. The orifice 31 located within the cycling container to be positioned so as to evacuate the maximum container water 49 when the cycling container is resting on the bottom of the liquid pumping chamber 13. The remaining orifice liquid orifice 35 allows liquid communication between liquid pumping chamber 13 and heating chamber 15 through liquid pipe 37. The heating chamber 15 is provided with two orifices, namely a gas orifice 41 connected to gas pipe 43, a liquid orifice 39 connected to lower pipe 37.

The operation of the present invention will be discussed with reference to FIG. 4. The beginning of the cycle is shown in FIG. 4. A volume of pressurized gas or stream generated within the heating chamber 15 by an external heat energy source 55 enters the liquid pumping chamber 11 through gas pipe 43 and exerts a force upon the surfaces of the liquid 49 is forced out of the chambers through the end of the output tube end 31 located within the cycling container 33. When the chamber liquid has been lowered to a predetermined level pressurized gas vents itself through the output tube 29. The chamber gas pressure is lowered to atmospheric pressure. The reservoir water pressure is now greater than the inner chambers pressure. The flapper valve 21 connected to the reservoir opens, and water flows into the bottom of the chambers. The cycling container, now buoyant, rises as the chambers refills. The cycling container, because of its assembly to the output tube 29 and to the flexible joint 27, and its location on the lower liquid chamber wall, travels in a vertical circular arc as the water moves upward. At a predetermined point the cycling container will began to fill with water, and when partially filled it is no longer buoyant. It sinks to the bottom of the chamber. The pressurized gas can no longer vent to the atmosphere. The heated gas 51 now contained begins to exert pressure on the surface of the liquid 49. The cycle repeats.

Figures 5, 6:
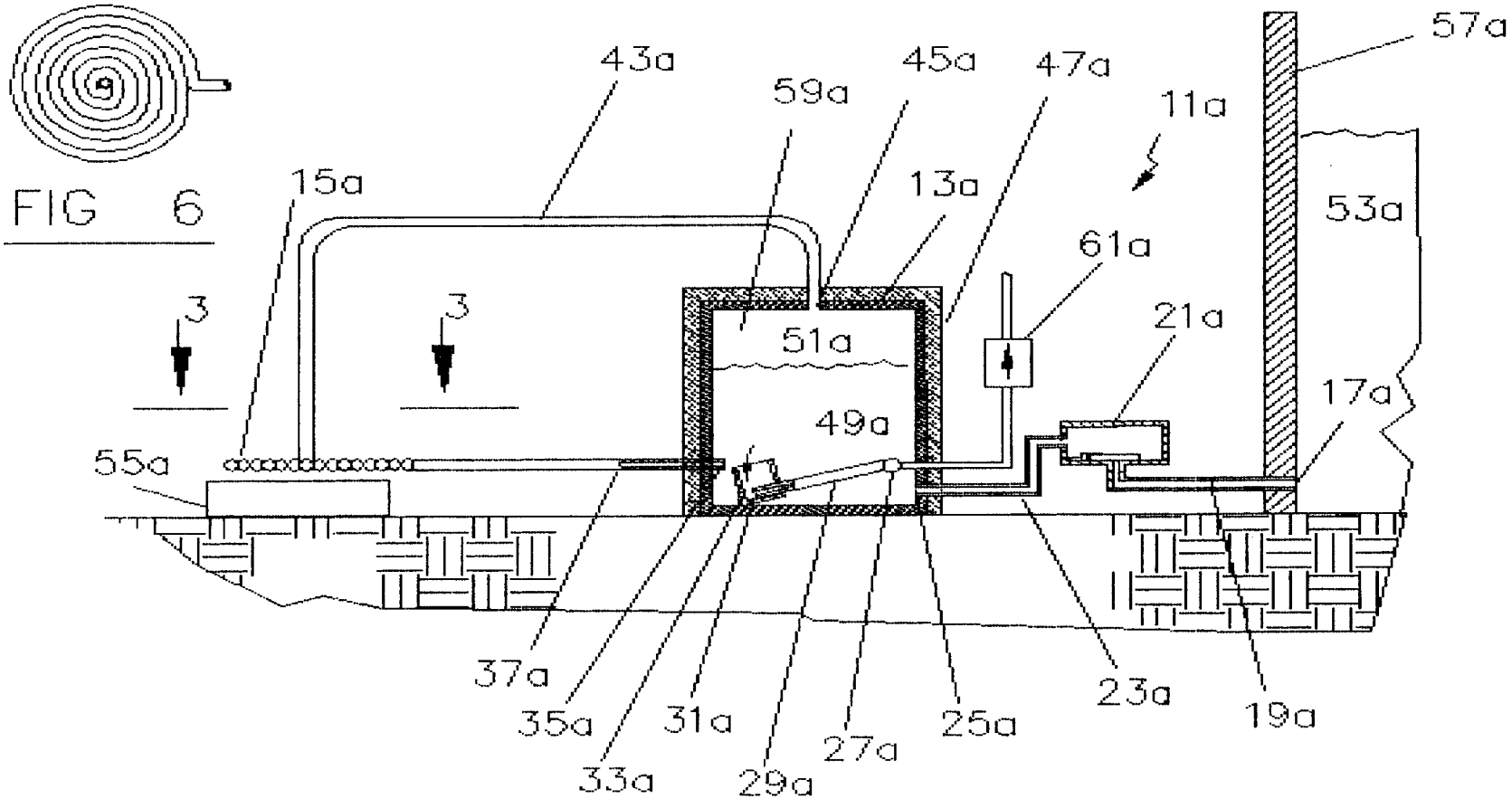
FIG. 5 is a partial cross section of an alternate embodiment of the present invention.
FIG. 6 is a partial cross section taken along line 3—3 of FIG. 5

Referring to FIG. 5. A third embodiment of a pump mechanism modified to function as a land based operation near a reservoir.

Referring to FIG. 5. A heat engine pump mechanism 11*a*, a liquid pumping chamber 13*a*, covered with insulation 47*a*, a heating coil 15*a* with a heat producing source 55*a* below coil, reservoir 57*a* provided with one orifice 17*a* allowing communication between the reservoir liquid 53*a* and the liquid valve 21*a* through reservoir output pipe 19*a*. The liquid pumping chamber 13*a* is a cylinder, but can be made in any appropriate shape. The liquid pumping chamber 13*a* is preferably provided with four orifices, allowing communication with the internal liquid pumping chamber 59*a*, namely a gas orifice 45*a* connected to gas pipe 43*a*, a liquid input orifice 25*a* connected to input pipe 23*a*, an output orifice 31*a* associated with liquid output pipe 29*a* an output orifice 35*a* connected to liquid pipe 37*a* Output pipe 29*a* connected to swivel coupling 27*a*. Output pipe 29*a* is connected to cycling container 33*a* and one way valve 61*a*. The orifice 31*a* located within the cycling container to be positioned so as to evacuate the maximum container water 49*a* when the cycling container is resting on the bottom of the liquid pumping chamber 13*a*.

The operation of the present invention will be discussed with reference to FIG. 5. The beginning of the cycle is shown in FIG. 5 A volume of pressurized gas or steam generated within the heating coil 15*a* by an external heat energy source 55*a* enters the liquid pumping chamber 13*a* through pipe 43*a* and exerts a force upon the surfaces of the chamber liquid. The chamber liquid 49*a* is forced out of the chamber through the end of the output tube end 31*a* located within the cycling container 33*a*. When the chamber liquid has been lowered to a predetermined level pressurized gas vents itself through the output tube 29*a* and one valve 61*a*. The chamber gas pressure is lowered to atmospheric pressure. The reservoir water pressure is now greater than the inner chambers pressure. The flapper valve 21*a* connected to the reservoir opens, and water flows into the bottom of the chamber. The cycling container, now buoyant, rises as the chambers refills. The cycling container, because of its assembly to the output tube 29*a* and to the flexible joint 27*a*, and its location on the lower liquid chamber wall, travels in a vertical circular arc as the water moves upward. At a predetermined point the cycling container will began to fill with water, and when partially filled it is no longer buoyant. It sinks to the bottom of the chamber. The pressurized gas can no longer vent to the atmosphere. The heated gas 51*a* now contained begins to exert pressure on the surface of the chambers liquid 49*a*. The cycle repeats.

While this invention has been described in terms of a few preferred embodiments, it is contemplated that persons reading the proceedings descriptions and studying the drawings will realize various alterations, permutations and modifications thereof. It is therefore intended that the following appended claims be interpreted as including all such alterations, permutations and modification as fall within the true spirit and scope the present invention.

What is claimed is:

1. An external combustion heat engine pump mechanism adapted to float the surface of a reservoir of liquid, said heat engine pump comprising:

(a) an enclosure provided with a float and within said enclosure are located four chambers one liquid pumping chamber, one gas pumping chamber, one cooling chamber and one heating chamber with attached heat source;

(b) said liquid pumping chamber further having a gas input pipe permitting communication between said liquid pumping chamber and said heating chamber, a liquid orifice permitting communication between said liquid reservoir and said liquid pumping chamber, a liquid orifice permitting communication between said liquid pumping chamber and said gas pumping chamber, a gas orifice permitting communication between said liquid pumping chamber and said gas pumping chamber, a liquid output orifice located on a lower wall of liquid pumping chamber, a hollow cycling container, buoyant when nearly empty, coupled to said output orifice with said output pipe permitting communication between said cycling container and output pipe;

(c) said cycling container adapted to sink when pump liquid rises above a predetermined level within said liquid pumping chamber;

(d) first swivel joint means coupled to said cycling container and output pipe to allow vertical circular arc travel of said cycling container, as liquid rises, or when said cycling container sinks;

(e) first check valve means associated with said liquid orifice to allow one way flow of liquid into said liquid pumping chamber from said reservoir;

(f) said gas pumping chamber further having a liquid orifice permitting communication between said gas pumping chamber and said liquid pumping chamber, gas orifice permitting communication between said gas pumping chamber and said liquid pumping chamber, a bellows with attached float, installed within said gas pumping chamber ceiling with lower end of said bellows unattached;

(g) second check valve means associated with said gas orifice to allow one way flow of gas into said heating chamber from said bellows;

(h) attachment means for securing float to said bellows;

(i) said heating chamber further having a gas orifice permitting communication between said heating chamber and said liquid pumping chamber, said gas orifice permitting communication between said heating chamber and said bellows;

(j) said cooling chamber further having a gas outlet orifice permitting communication between said cooling chamber and said bellows, outer surface of said cooling chamber to be coated with reflective paint;

(k) third check valve means associated with said gas outlet orifice for allowing one way flow of gas into said bellows from said cooling chamber; and (l) construction means for installing coiled thin wall tubing with water sealed inside said tubing the length of said cooling chamber.

2. A land based heat engine pump mechanism adapted to be located beside and at a distance from a reservoir of liquid, said pump mechanism comprising:

(a) four chambers, one liquid pumping chamber, one gas pumping chamber, one cooling chamber and one heating chamber with attached heat source;

(b) said liquid pumping chamber further having a gas input pipe permitting communication between said liquid pumping chamber and said heating chamber, a liquid orifice permitting communication between said liquid reservoir and said liquid pumping chamber, a liquid orifice permitting communication between said liquid pumping chamber and said gas pumping chamber, a gas orifice permitting communication between said liquid pumping chamber and said gas pumping chamber, liquid output orifice located on a lower wall of liquid pumping chamber, a hollow cycling container, buoyant when nearly empty, coupled to said output orifice with said output pipe permitting communication between said cycling container and output pipe;

(c) said cycling container adapted to sink when said pump liquid rises above a predetermined level within said liquid pumping chamber;

(d) first swivel joint means coupled to said cycling container and output pipe to allow vertical circular arc travel of said cycling container, as said pump liquid rises, or when said cycling container sinks;

(e) first check valve means associated with said liquid orifice to allow one way flow of liquid into said liquid pumping chamber from reservoir;

(f) said gas pumping chamber further having a liquid orifice permitting communication between said gas pumping chamber and said liquid pumping chamber, gas orifice permitting communication between said gas pumping chamber and said liquid pumping chamber, bellows with attached float installed within said gas pumping chamber ceiling with lower end of bellows unattached;

(g) second check valve means associated with said gas orifice to allow one way flow of gas into said heating chamber from said bellows;

(h) attachment means for securing float to said bellows;

(i) said heating chamber further having a gas orifice permitting communication between said heating chamber and said liquid pumping chamber, said gas orifice permitting communication between said heating chamber and said bellows;

(j) said cooling chamber further having a gas outlet orifice permitting communication between said cooling chamber and said bellows, an outer surface of said cooling chamber coated with reflective material;

(k) third check valve means associated with said gas outlet orifice for allowing one way flow of gas into said bellows from said cooling chamber; and (l) construction means for installing coiled thin wall tubing within said cooling chamber with water sealed inside said coiled tubing the length of said cooling chamber.

3. A land based heat engine pump mechanism adapted to be located beside and at a distance from a reservoir of liquid, said pump mechanism comprising:

(a) two chambers, one liquid pumping chamber, one gas heating chamber with attached beat source;

(b) said liquid pumping chamber further having a gas input pipe permitting communication between said liquid pumping chamber and said heating chamber, liquid orifice permitting communication between said liquid reservoir and said liquid pumping chamber liquid output orifice located on a lower wall of liquid pumping chamber, a hollow cycling container, buoyant when nearly empty, coupled to said output orifice with said output pipe permitting communication between said cycling container and output pipe;

(c) said cycling container adapted to sink when pump liquid rises above a predetermined level within said liquid pumping chamber;

(d) first swivel joint means coupled to said cycling container and output pipe to allow vertical circular arc travel of said cycling container, as said pump liquid rises, or said cycling container sinks;

(e) first check valve means associated with said liquid orifice to allow one way flow of said pump liquid into said liquid pumping chamber from said liquid reservoir;

(f) heating chambers further having gas orifice permitting communication between said heating chamber and said liquid pumping chamber; and (g) said liquid pumping chamber outside ceiling and wall lined with insulation.

4. A land based heat engine pump mechanism adapted to be located beside and at a distance from a reservoir of liquid, said pump mechanism comprising:

(a) one liquid pumping chamber with attached heating coil;

(b) said liquid pumping chamber further having a gas input pipe permitting communication between said liquid pumping chamber and said heating coil, liquid orifice permitting communication between said liquid reservoir and said liquid pumping chamber, liquid output orifice located on lower wall of liquid pumping chamber, a hollow cycling container, buoyant when nearly empty, coupled to said output orifice with said output pipe permitting communication between said cycling container and output pipe;

(c) said cycling container adapted to sink when said pump liquid rises above a predetermined level within said liquid pumping chamber;

(d) first swivel joint means coupled to said cycling container and said output pipe to allow vertical circular arc travel of said cycling container, as said liquid rises, or said cycling container sinks;

(e) first check valve means associated with said liquid orifice to allow one way flow of said liquid into said liquid pumping chamber from said reservoir;

(f) said liquid pumping chamber further having said liquid orifice permitting communication between said liquid pumping chamber and said heating coil;

(g) said liquid pumping chamber outside ceiling and wall lined with insulation;

(h) construction means for assembly of hollow metal tubing of said heating coil to said liquid pumping chamber's said gas input pipe and said liquid output pipe; and (i) second check valve means associated with said liquid orifice to allow one way flow of said liquid from said liquid pumping chamber through said output pipe.

* * * * *